US005218409A

United States Patent [19]

Tanaka et al.

[11] Patent Number: 5,218,409

[45] Date of Patent: Jun. 8, 1993

[54] IMAGE FORMING APPARATUS

[75] Inventors: Masayuki Tanaka; Kunio Tsuboi, both of Hyogo, Japan

[73] Assignee: Sanyo Electric Co., Ltd., Osaka, Japan

[21] Appl. No.: 583,941

[22] Filed: Sep. 17, 1990

[30] Foreign Application Priority Data

Sep. 19, 1989 [JP] Japan ..... 1-110234[U]
Sep. 19, 1989 [JP] Japan ..... 1-244004
Sep. 19, 1989 [JP] Japan ..... 1-244005

[51] Int. Cl.[5] ..... G03G 21/00

[52] U.S. Cl. ..... 355/246; 355/204; 355/208; 118/688; 118/689

[58] Field of Search ..... 355/246, 260, 203, 204, 355/208, 326, 327, 245; 118/688-690

[56] References Cited

U.S. PATENT DOCUMENTS 4,167,322 9/1979 Yano et al. ..... 355/204 X
4,851,875 7/1989 Tanimoto ..... 355/245
4,912,512 3/1990 Midorikawa et al. ..... 355/260
4,932,356 6/1990 Watanabe et al. ..... 118/689
4,956,668 9/1990 Arnold et al. ..... 355/208
4,963,939 10/1990 Kurando et al. ..... 355/260
5,012,286 4/1991 Kawano et al. ..... 355/246

FOREIGN PATENT DOCUMENTS 0035576 2/1989 Japan .
0035580 2/1989 Japan .
0232360 9/1989 Japan .

*Primary Examiner*—A. T. Grimley
*Assistant Examiner*—Matthew S. Smith
*Attorney, Agent, or Firm*—Darby & Darby

[57] ABSTRACT

An image forming apparatus is loaded with a developing device capable of being easily exchanged, and a toner sensor for detecting a toner density is provided in association with the developing device. An output signal of the toner sensor approaches 0 V as a weight of a developer becomes small. Therefore, when the output signal from the toner sensor is detected prior to an agitating screw is operated when a power source is turned-on, it is possible to determine whether a developing device attached at that time is an unused or used one in accordance with the output signal. In addition, the output of the toner sensor when the developing device is an unused one is stored in a backed-up memory as a reference value for controlling a toner density during an actual operation.

6 Claims, 4 Drawing Sheets

IMAGE FORMING APPARATUS

BACKGROUND OF THE INVENTION

1. Field of the Invention

The present invention relates to an image forming apparatus. More specifically, the present invention relates to an image forming apparatus in which a developing device which develops a latent image formed on a medium with a toner can be easily exchanged.

2. Description of the Prior Art

In general, a toner density of an image forming apparatus is detected by a toner sensor which is provided in association with a developing device. Such a toner sensor is to be adjusted so that an output thereof becomes a predetermined reference value prior to an image forming apparatus is forwarded from a manufacturing factory or prior to an image forming apparatus is settled for a user. However, an adjustment operation of the toner sensor is very troublesome.

SUMMARY OF THE INVENTION

Therefore, a principal object of the present invention is to provide a novel image forming apparatus.

Another object of the present invention is to provide an image forming apparatus in which it is not necessary to adjust a toner sensor initially.

Another object of the present invention is to provide a method in which it is possible to simply determine whether a developing device is an unused developing device or a used developing device in an image forming apparatus which is provided with a developing device capable of being easily exchanged.

The other object of the present invention is to provide an image forming apparatus provided with a developing device capable of being easily exchanged, in which it is possible to simply identify a color of a toner contained in the developing device.

An image forming apparatus in accordance with the present invention comprises: a developing device; a toner sensor provided in association with said developing device for detecting a toner density; and holding means for holding an output obtained from said toner sensor at a timing when said developing device is an unused developing device as a reference value for controlling a toner density.

In the present invention, when the developing device is an unused one, or when an image forming apparatus itself is an unused one, an output of the toner sensor is held by the holding means such as a memory which is backed up by a battery, for example. Therefore, when the image forming apparatus is actually used, the reference value held by the holding means and an output of the toner sensor is compared with each other.

In one aspect of the present invention, the above described toner sensor is used for determining an unused developing device or a used developing device. More specifically, since the toner sensor outputs a voltage approaching 0 V as a weight of a developer is reduced, if an output of approximately 0 V of the toner sensor is detected prior to a screw is operated when a power source is turned-on, for example, it is possible to determined that a developing device loaded in an image forming apparatus at that time is an unused developing device. Then, in accordance with this embodiment, if a developing bias and etc. are initially set in response to a signal which detects an unused developing device, it becomes unnecessary to provide a reset switch which was provided in a conventional image forming apparatus and used for initially setting a developing bias and etc.

In another aspect of the present invention, a developing device capable of being easily exchanged is provided with a resistor having a resistance value peculiar to a color of a toner contained in the developing device, and a toner color can be determined based upon the resistance value of the resistor. An image forming apparatus is provided with a connector connected to the resistor, which is connected in turn to an A/D converter via a pull-down resistor. Therefore, voltage data in accordance with the resistance value of the resistor of the developing device to which the resistor is attached is outputted from the A/D converter. It is determined that a toner color is black, for example, when the output data of the A/D converter is below 1 V. In addition, when the output data of the A/D converter is more than 1 V but below 2 V, it is determined that a toner color is red, for example. When the output data of the A/D converter is more than 2 V but below 3 V it is determined that a toner color is blue, for example, when the output data of the A/D converter is more than 3 V but below 4 V it is determined that a toner color is yellow, for example and, when the output data of the A/D converter is more than 4 V but below 5 V it is determined that a toner color is green, for example. In accordance with this embodiment, it is not necessary to use specific microswitches which were provided in a conventional image forming apparatus to determine a toner color.

The objects and other objects, features, aspects and advantages of the present invention will become more apparent from the following detailed description of the embodiments of the present invention when taken in conjunction with accompanying drawings.

BRIEF DESCRIPTION OF THE DRAWINGS

FIG. 5A shows relationship between an output of a toner sensor and a toner density and FIG. 5B shows relationship between an output of a toner sensor and a weight of developer.

DETAILED DESCRIPTION OF THE PREFERRED EMBODIMENTS

Figure 1:
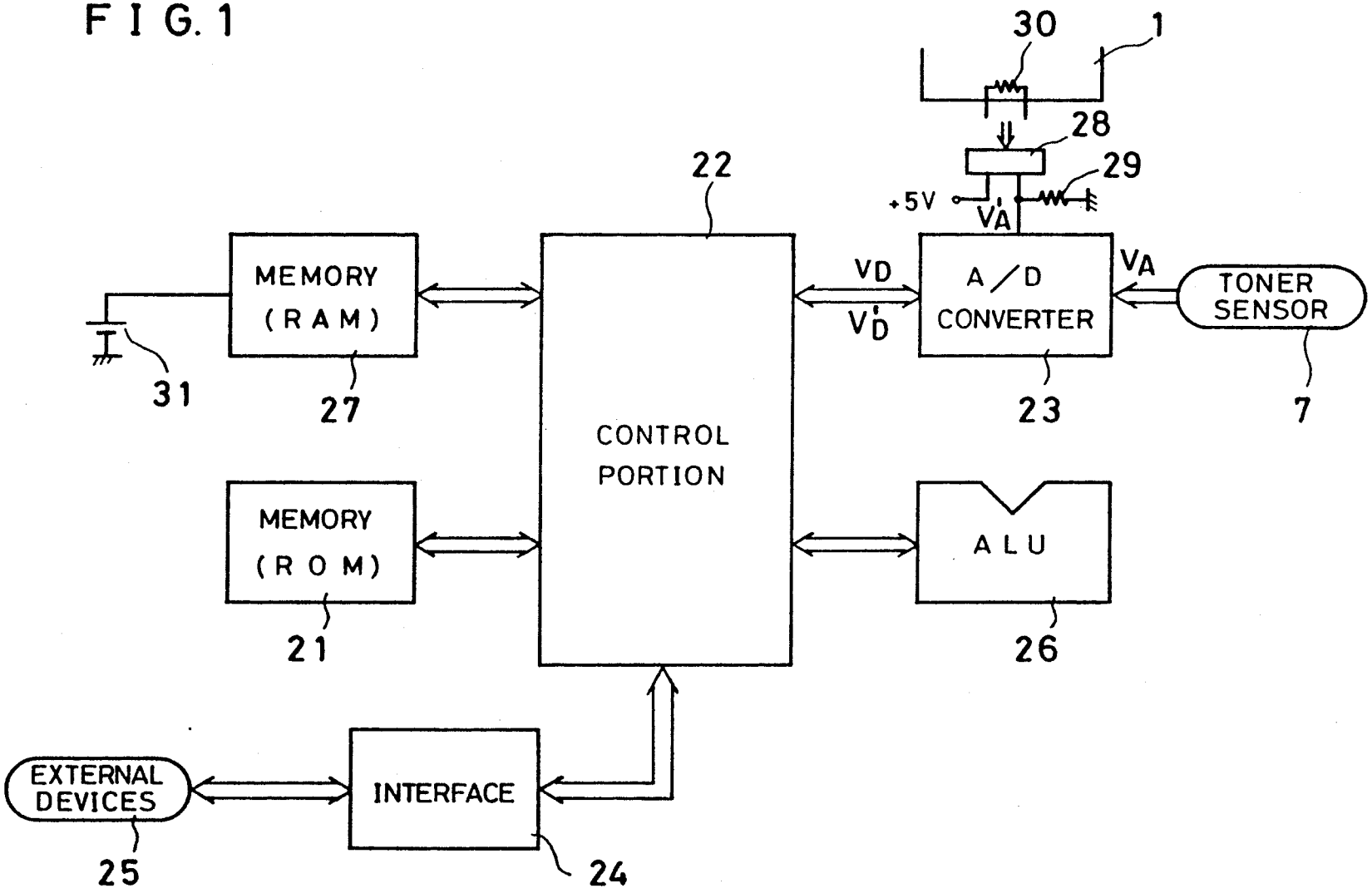
FIGS. 1 is a block diagram showing a major portion of a control circuit for controlling an image forming apparatus in accordance with the present invention.

With reference to FIG. 1, control instructions stored in a memory (read-only memory) 21 are given to a control portion 22 composed of a microcomputer, for example, whereby an operation of an image forming apparatus can be controlled by the control portion 22 as a whole. A signal outputted from a toner sensor 7 is inputted to an A/D converter 23, and signals from the control portion 22 are applied to external devices 25 (driving motor, display panel, jam sensor, key panel, solenoid and etc.) through an interface 24. Predetermined calculations or operations are executed in an operation portion 26 based upon the data or signals inputted from the toner sensor 7, i.e. A/D converter 23 and the external devices 25, and operation results thereof or the like are stored in a memory (random access memory) 27. A connector 28 is connected to the A/D converter 23 through a pull-down resistor 29. A resistor 30 which is provided within a developing device 1 and has a predetermined resistance value peculiar to a color of a toner contained in the developing device 1 is connected to the connector 28.

Figure 3:
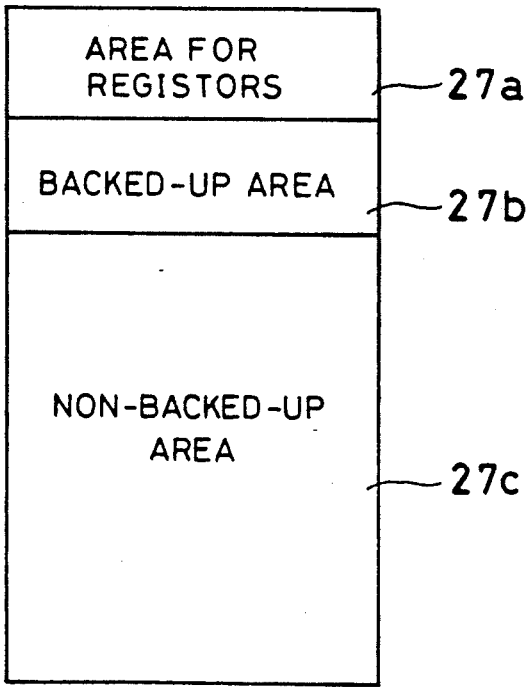
FIG. 3 is an illustrative view showing structure of a memory of FIG. 1 embodiment.

As shown in FIG. 3, the memory 27 includes an area 27*a* assigned to registers or the like which are exclusively utilized by the control portion 22, a backed-up area 27*b* in which contents are held by a battery 31 even if a power source is turned-off, and a non backed-up area 27*c* which is assigned to flags, timers and etc. and initialized at every timing when the power source (not shown) is turned-on.

Figure 2:
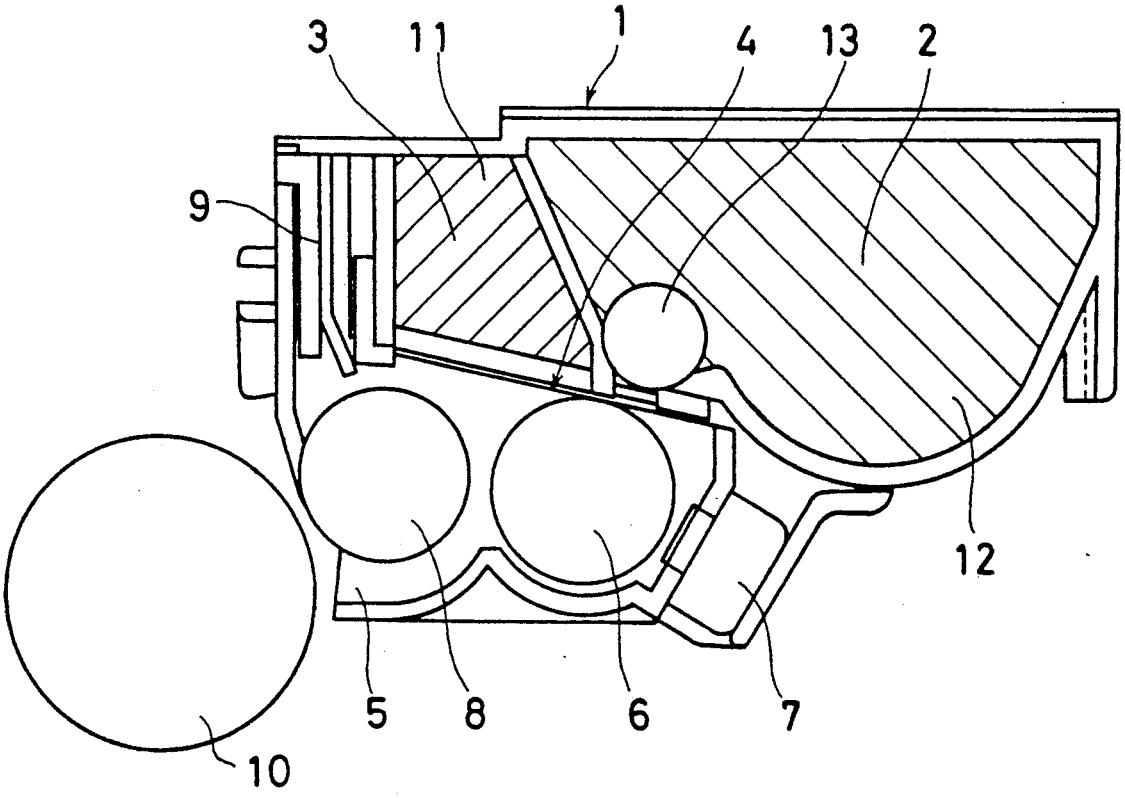
FIG. 2 is a partially cross-sectioned view showing the circumference of a developing device of an image forming apparatus in accordance with the present invention.

With reference to FIG. 2, the developing device 1 attached to the image forming apparatus of this embodiment shown includes a toner containing portion 2 for containing a toner 12 and a developer containing portion 3 for containing a developer 11. Then, before the developing device 1 is used, the toner containing portion 2 and the developer containing portion 3 are respectively separated from a developer box 5 by a film 4.

The developer box 5 is provided with a screw 6 for agitating the developer 11, the toner sensor 7 for detecting a toner density of the developer 11, a magnet roller 8 for conveying the developer 11 as agitated toward a photosensitive member 10 for forming an image, and a doctor blade 9 for defining an amount of the developer 11 forwarded to the photosensitive member 10.

When the developing device 1 is operated, the toner 12 which is mixed in the developer 11 is consumed on the photosensitive member 10, and therefore, it is necessary to detect a change of a toner density in the developer by the toner sensor 7 and resupply a toner 12 by a toner resupply roller 13 from the toner containing portion 2 to the developer box 5.

As such a toner sensor 7, a toner sensor which replaces changes of a toner in a two-component developer and an amount of the developer with a change of permeability and outputs an analog voltage which is changed in accordance with the change of permeability is utilized. In this embodiment shown, as the toner sensor 7, "TS0524ANA-X" manufactured by TDK is used.

Figure 5A:
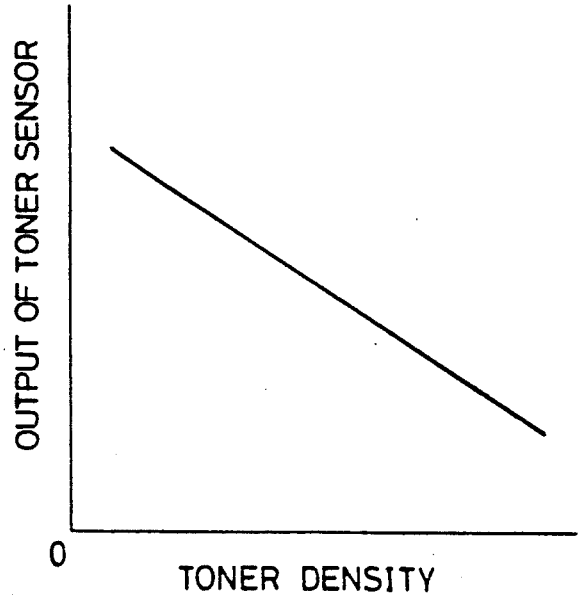
FIGS. 5A and 5B are graphs showing characteristics of a toner sensor of FIG. 1 embodiment.
Figure 5B:
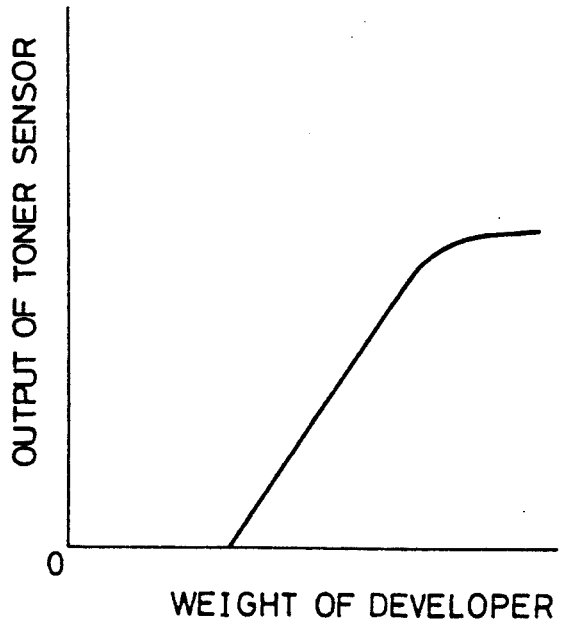

An output voltage of the toner sensor 7 is in inverse proportion to a toner density as shown in FIG. 5A. However, even if the toner density is slightly increased, the output voltage never falls approximately 0 V. In addition, the output voltage of the toner sensor 7 is in proportion to a weight of the developer 11 and decreases as the weight of the developer 11 decreases. Therefore, by utilizing the output voltage of the toner sensor 7, it is possible to detect a state where no developer 11 exists.

In a case where the developing device 1 is an unused developing device, the film 4 is removed by an operator in a state where the developing device 1 is attached to the image forming apparatus, and thereafter, the screw 6 is operated so that the developer 11 is initially conveyed to the vicinity of the toner sensor 7. Therefore, by detecting the output voltage of the toner sensor 7 before the screw 6 is operated when the power source is turned-on, it is possible to determine whether the developing device 1 is a new one or an old one, that is, whether or not the developing device 1 is an unused one.

A voltage signal $V_A'$ obtained by dividing by means of the pull-down resistor 29 and a resistor 30 provided on the developing device 1 is converted into digital data by the A/D converter 23. The pull-down resistor 29 and the resistor 30 are set in advance so that an, output voltage $V_D'$ represented by the data is different from that to be identified in accordance with a color of a toner within the developing device 1. In this embodiment shown, resistance values of the pull-down resistor 29 and the resistor 30 are set so that an output voltage $V_D'$ below 1 V represents black, the output voltage more than 1 V and below 2 V represents red, the output voltage more than 2 V and below 3 V represents blue, the output voltage more than 3 V and below 4 V represents yellow, and the output voltage more than 4 V and below 5 V represents green. Therefore, it is possible to determine a color of a toner contained in the developing device 1 in accordance with the output voltage of the A/D converter 23.

In addition, colors to be determined and the number thereof can be arbitrarily changed and set in accordance with discrimination or resolution of the A/D converter 23.

Figure 4:
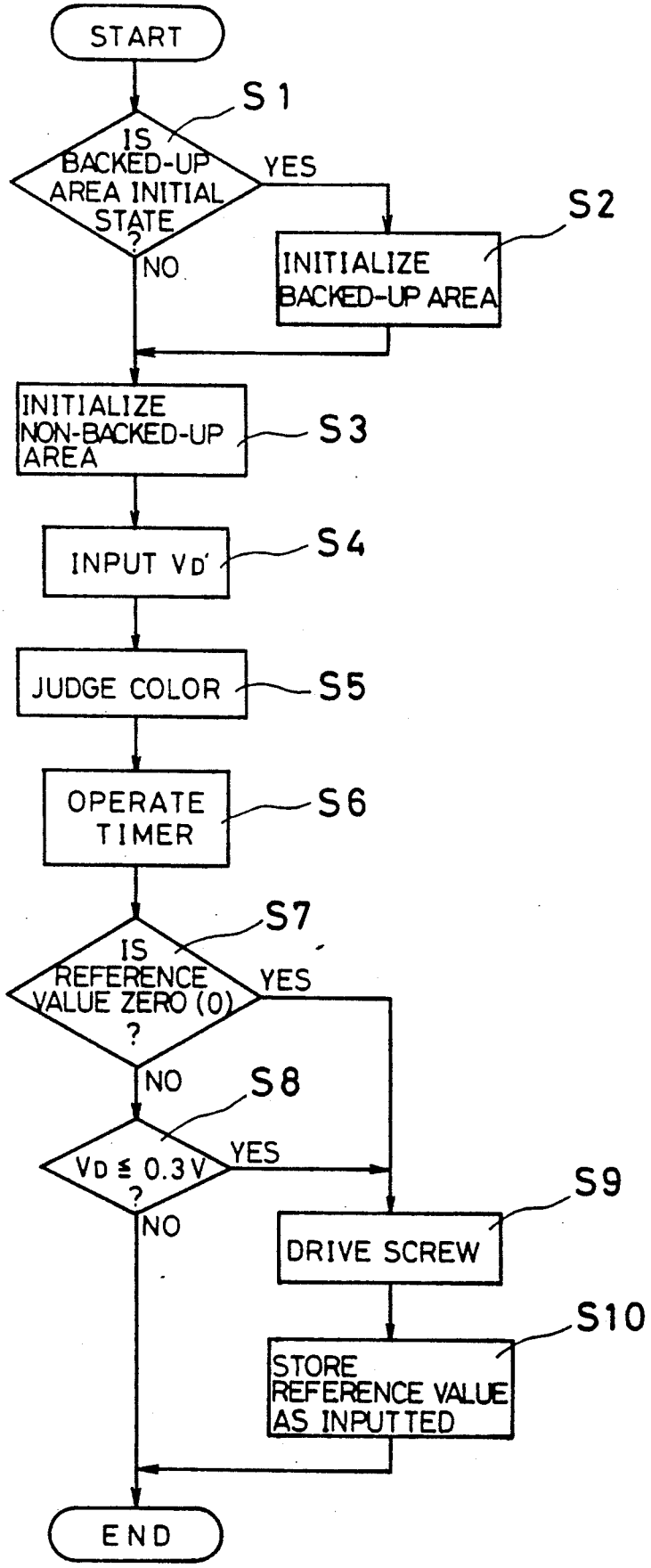
FIG. 4 is a flowchart showing an operation of FIG. 1 embodiment.

An operation of the developing device 1 in an image forming apparatus having the above described structure will be described with reference to a flowchart of FIG. 4. In addition, it is convenient that the flowchart shown in FIG. 4 is constructed to be executed after a timing when the developing device 1 is expected to be exchanged (for example, in turning the power source on).

First, in the step S1, predetermined addresses of the backed-up area 27*b* in the memory 27 are read and it is determined whether or not the backed-up area 27*b* is backed up by the battery 31 (FIG. 1). Then, if a state where the same is not backed up (an initial state) is determined in the step S1, the process proceeds to the step S2.

In the step S2, the initialization of the backed-up area 27*b* is executed, and thereafter, the process proceeds to the step S3.

The initialization of the non backed-up area 27*c* is executed in the step S3, and the process proceeds to the step S4.

In the step S4, the voltage data $V_D'$ obtained through digitalization of the voltage $V_A'$ in the A/D converter 23, said voltage $V_A'$ being obtained by dividing by means of the pull-down resistor 29 and the resistor 30 attached to the developing device 1, is fetched, and the process proceeds to the step S5.

In the step S5, a color of a toner contained in the developing device 1 which is mounted at that time is determined based upon the voltage data $V_D'$, and the process proceeds to the step S6.

In addition, in this embodiment shown, an operation in a case where the voltage data $V_D'$ is representing a voltage more than 1 V but below 2 V and thus the toner is determined as red will be described in the following.

In the step S6, a timer is operated to wait until the output of the toner sensor 7 sufficiently rises, and the process proceeds to the step S7.

In the step S7, a reference value for red for controlling a toner density from the predetermined addresses of the backed-up area 27*b* of the memory of 27 is read, and it is determined whether or not the reference value is "0". If the reference value is "0", it is determined that a developing device 1 of red is in an initial state with respect to the image forming apparatus, that is, in a starting state of the use, and the process proceeds to the step S9. A reason why the initial state can be determined will be described later. In addition, in a case where the reference value is not "0", the process proceeds to the step S8.

In the step S8, the voltage data $V_D'$ which is obtained through the digitalization of the output voltage $V_A$ from the toner sensor 7 in the A/D converter 23 is inputted, and it is determined whether or not the voltage data $V_D$ is in the vicinity of 0 V, that is, whether or not the developing device is an unused one. In this embodiment shown, when the voltage is less than 0.3 V, it is determined that the voltage data $V_D$ is in the vicinity of 0 V. If the voltage data is less than 0.3 V, the process proceeds to the step S9. This threshold value (0.3 V) may be an arbitrary value as far as the same is less than a value outputted from the toner sensor 7 during when the developing device 1 is normally operated. In addition, a reason why it is determined that the developing device 1 is an unused one when the voltage data $V_D$ is in the vicinity of 0 V is as previously described.

In the step S9, the screw 6 is driven for a predetermined time period to agitate the developer 11, and the process proceeds to the step S10. In response thereto, the developer 11 is initially conveyed to the vicinity of the toner sensor 7 provided on the developer box 5. In addition, it is necessary to remove the film 4 by an operator prior to the use thereof.

In the step S10, the voltage data $V_D'$ obtained through the digitalization of the output voltage $V_A$ of the toner sensor 7 by means of the A/D converter 23 is inputted and the voltage data $V_D'$ is stored in the predetermined address of the backed-up area 27*b* of the memory 27 as a reference value for controlling a toner density of a red toner.

In addition, in a case where it is determined that a toner within the developing device 1 is a color other than red in the step S4, a reference value obtained in the above described manner is stored in an address corresponding to the color. Therefore, when the developing device of the color has been used in the image forming apparatus, the reference value of the developing device of the color is stored in a predetermined position of the backed-up area 27*b* of the memory 27. Therefore, by determining whether or not the reference value corresponding to a determined color is "0" in the step S7, it is possible to determine that a developing device having a toner of that color is initially used in that image forming apparatus.

In addition, in the step S10, not only the reference value for controlling a toner density but also a developing bias and etc. for toners of respective colors may be set.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a developing device which contains a toner for developing a latent image;

a toner sensor provided on said developing device for detecting a toner density;

a status determining means for determining whether or not said developing device is in an unused state on the basis of an output obtained from said toner sensor; and holding means for holding the output obtained from said toner sensor as a reference value for controlling the toner density when the developing device is determined to be in said unused state by said status determining means.

2. An image forming apparatus in accordance with claim 1, wherein said image forming apparatus is adapted to use toners of a plurality of colors, and said holding means is adapted to hold said reference value for each color, further comprising means for determining whether or not said reference value of each of all the colors is at a predetermined value.

3. An image forming apparatus in accordance with claim 1, wherein said holding means includes a backed-up memory.

4. An image forming apparatus in accordance with claim 1, wherein said developing device includes a resistance element having a resistance value peculiar to a color of a toner which is contained in said developing device, further comprising color detecting means for detecting a color of said toner in accordance with said resistance value when said developing device is attached.

5. An image forming apparatus in accordance with claim 4, wherein said color detecting means includes converting means for converting said resistance value of said resistance element into a signal having a magnitude corresponding thereto, and magnitude determining means for determining said magnitude of said signal.

6. An image forming apparatus, comprising:

a developer box provided with a developing device for containing a toner for developing a latent image, said developing device including a toner containing portion for containing a toner, a developer containing portion for containing a developer and a screw for agitating said developer;

developer detecting means for detecting whether or not a developer exists in said developer box, said developer detecting means detecting a toner density within said developer box during an image forming operation; and means for determining that a developing device attached at that time is an unused developing device when said developer detecting means detects an absence of the developer.

* * * * *